United States Patent [19]

Kuhlmann

[11] Patent Number: 4,551,224

[45] Date of Patent: Nov. 5, 1985

[54] COAL LIQUEFACTION PROCESS

[75] Inventor: Erven J. Kuhlmann, Hopewell Jct., N.Y.

[73] Assignee: Texaco Inc., White Plains, N.Y.

[21] Appl. No.: 562,323

[22] Filed: Dec. 16, 1983

[51] Int. Cl.[4] ..... C10G 1/06; C10G 1/00

[52] U.S. Cl. ..... 208/10; 208/8 LE; 208/11 LE

[58] Field of Search ..... 208/8 LE, 10, 11 LE, 208/14

[56] References Cited

U.S. PATENT DOCUMENTS

| | | | |
|---|---|---|---|
| 3,477,941 | 11/1969 | Nelson | 208/10 |
| 3,505,203 | 4/1970 | Nelson | 208/8 LE |
| 4,097,361 | 8/1978 | Ashworth | 208/8 LE X |
| 4,189,371 | 2/1980 | Maa | 208/8 LE |
| 4,191,700 | 3/1980 | Lebowitz et al. | 208/10 X |
| 4,227,989 | 10/1980 | Gorbaty et al. | 208/10 X |
| 4,437,974 | 3/1984 | Minami et al. | 208/10 |
| 4,440,622 | 4/1984 | Derbyshire et al. | 208/8 LE |
| 4,452,688 | 6/1984 | Mitchell et al. | 208/10 |

*Primary Examiner*—D. E. Gantz
*Assistant Examiner*—William G. Wright
*Attorney, Agent, or Firm*—Robert A. Kulason; Albert Brent

[57] ABSTRACT

Process for liquefying coal or similar liquefiable carbonaceous solids in which the liquefaction solvent is a hydrotreated solvent mixture that is derived in the process. The solvent mixture comprises at least 78 wt. % decalin, comprising cis and trans decalin. The cis-isomers comprise at least 80 wt. % of the total weight of the decalin. The solvent mixture may also include about 0–2 wt. % of naphthalene, about 0–5 wt. % of a constituent comprising the mono and/or di methyl derivative of at least one of the other constituents in the mixture, and tetralin comprising the remainder, e.g., about 1–22 wt. %.

16 Claims, 1 Drawing Figure

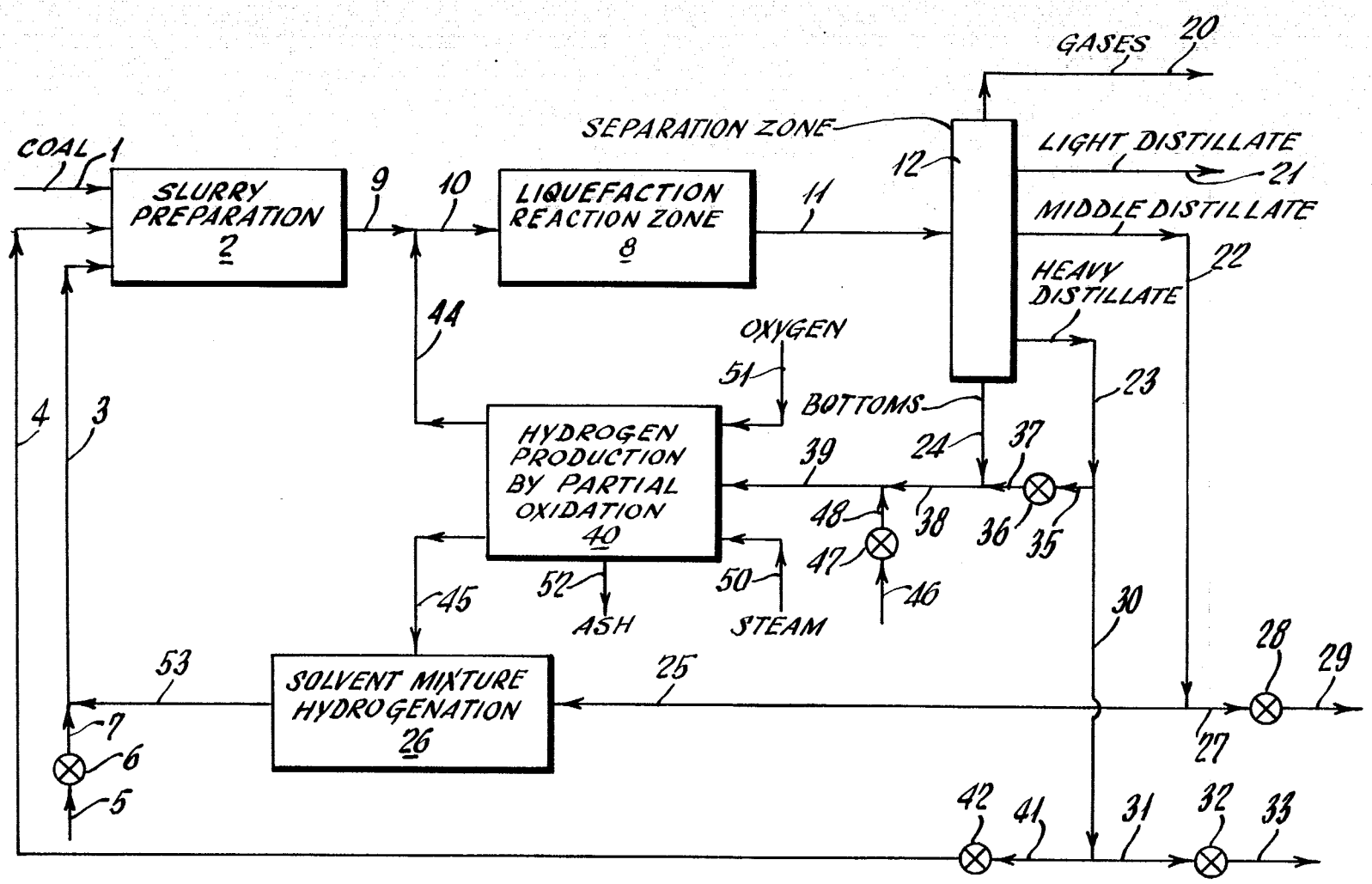
COAL
SLURRY PREPARATION 2
LIQUEFACTION REACTION ZONE 8
HYDROGEN PRODUCTION BY PARTIAL OXIDATION 40
SOLVENT MIXTURE HYDROGENATION 26
SEPARATION ZONE
GASES
LIGHT DISTILLATE
MIDDLE DISTILLATE
HEAVY DISTILLATE
BOTTOMS
OXYGEN
STEAM
ASH

COAL LIQUEFACTION PROCESS

BACKGROUND OF THE INVENTION

This invention relates to a process for liquefying coal or similar solid carbonaceous fuels. More particularly, this invention relates to an improved process-derived coal liquefaction solvent mixture predominantly comprising cis-decalin.

A large proportion, e.g. about 85%, of the world's estimated fossil fuel resources are in the form of solid carbonaceous fuels. Coal constitutes most of the recoverable deposits of solid carbonaceous fuels, e.g. about 80%. Oil shale and tar sands substantially comprise the remainder.

There are many well-known processes for the direct liquefaction of solid coal to produce light and heavy oils. These processes provide for the reduction of the molecular weight of the coal molecule while increasing the hydrogen content. The resulting liquids are then separated from the ash, e.g. mineral matter, and other unreactive solids.

The more important direct coal liquefaction processes today are basically variations of the same process using a process-derived solvent boiling in the 350° to 1000° F. range. In the Solvent Refined Coal Process (SRC) mineral matter from the coal is thought to catalyze a very mild hydrogenation of the process solvent in the course of the liquefaction reaction. Since the concentration of hydrogen donor species is believed to be minimal in this solvent, stabilization of the coal-free radicals would also occur through the presence of hydroaromatic structures in the coal itself (autostabilization), solvent hydrogen shuttling and the presence of dissolved molecular hydrogen in the reaction zone. Due to the inefficiency of radical stabilization by these methods, liquid yields are minimal. Higher liquid yields are obtained in another donor solvent process where the solvent has been catalytically hydrotreated in a separate reaction vessel to form appreciable amounts of hydroaromatic compounds in the solvent. For example, reference is made to U.S. Pat. Nos. 3,505,203 and 4,189,371. For a procedure which is supposed to produce even greater yields by introducing the hydrotreating catalyst into the coal liquefaction reactor, reference is made to U.S. Pat. No. 3,477,941. While the presence of a catalyst throughout liquefaction should theoretically maintain the solvent hydrogen donor capability at a maximum and also help to upgrade any coal liquids formed in the course of the reaction, rapid catalyst deactivation and handling difficulties are difficult problems to overcome.

It has been found unexpectedly that the coal derived liquefaction solvent mixture as produced in the subject process and predominantly comprising cis-decalin is the preferred paraffinic solvent for coal liquefaction.

SUMMARY

In accordance with the invention, a process for the liquefaction of ground coal or similar liquefiable carbonaceous solids is provided wherein the dried ground coal or similar liquefiable carbonaceous solids and the hydrotreated solvent mixture in a pumpable slurry are reacted together with or without a catalyst in the presence of a hydrogen-rich gas in a liquefaction reaction zone. The solvent mixture is produced in the process and comprises at least 78 wt. % decalin, comprising cis and trans-decalin. The cis-isomers comprise at least 80 wt. % of the total weight of the decalin in the solvent mixture. Also included in the solvent mixture is about 0–2 wt. % of naphthalene and/or about 0–5 wt. % of a constituent comprising the mono and/or di methyl derivative of at least one of the other constituents in the solvent mixture. Tetralin constitutes the remainder of the solvent mixture, e.g., about 1–22 wt. %. The effluent from the liquefaction reaction zone is separated by conventional methods including fractional and vacuum distillation into (a) a gaseous mixture comprising hydrogen-containing gases, hydrocarbonaceous gases and carbonaceous gases, (b) light hydrocarbon distillate, (c) middle hydrocarbon distillate, (d) heavy hydrocarbon distillate, and (e) a bottoms product comprising ash and hydrocarbonaceous and/or carbonaceous materials. Hydrogen-rich gas is produced from the bottoms product by the steps of partial oxidation, water-gas shifting, and gas purification. A portion of the hydrogen-rich gas is used in the catalytic hydrogenation of at least a portion of the middle distillate, to produce the previously described solvent mixture. Another portion of the hydrogen-rich gas is introduced into the liquefaction reaction zone. It was unexpectedly found that the coal-derived solvent mixture, as produced by the invention, will convert increased amounts of coal into valuable liquid products.

BRIEF DESCRIPTION OF THE DRAWING

In order to illustrate the invention in greater detail, reference is made to a preferred embodiment shown in the drawing.

DESCRIPTION OF THE INVENTION

A more complete understanding of the invention may be had by reference to the accompanying schematic drawing. Although the drawing illustrates a preferred embodiment of the invention, it is not intended to limit the subject invention by the particular apparatus or materials described. The drawing depicts a process for the liquefaction of coal using an improved process-produced, coal-derived recycle solvent mixture. The word "coal" where it appears in the following description is synonymous with "similar liquefiable carbonaceous solids."

Dried ground coal or similar solid carbonaceous fuel suitable for use in the subject process is passed through line 1 into a conventional slurry preparation zone 2. The coal may hve been dried and finely ground to the proper size prior to entering zone 2 where it is mixed with the process derived solvent mixture from line 3 and optionally heavy distillate recycle from line 4. Alternatively, separate streams of over-sized coal and solvent mixture may be introduced into slurry preparation zone 2 where the coal is dried, finely ground, and then slurried with the process derived solvent. The concentration of solids in the resulting pumpable slurry is in the range of about 16 to 91 weight percent (wt. %), such as about 33 to 50 wt. %. The coal particles have a particle size in the range of about ASTM E 11–70 Sieve Designation Standard 300 μm (Alternative No. 50) to Standard 45 μm (Alternative No. 325). The coal or similar liquefiable carbonaceous solids is selected from the group consisting of bituminous coal, sub-bituminous coal, anthracite coal, lignite, tar sands, oil shale, peat, and mixtures thereof.

The hydrotreated coal-derived solvent mixture in line 3 is an improvement over other primarily paraffinic solvents. It was unexpectedly found that by increasing the decalin content in the hydrogenated recycle solvent mixture to at least 78 to 95 wt. % of the total weight of the solvent mixture, and by increasing the cis-isomer content of the decalin to at least 80 weight % of the total weight of the decalin in the solvent, that the conversion of coal into liquid hydrocarbons is increased. Start-up or make-up solvent mixture is introduced into the system through line 5, valve 6, and line 7.

A hydrogen-rich gas, comprising by definition hydrogen gas with a purity of 80 vol. % or higher, and preferably substantially pure hydrogen, e.g., 98 vol. % or higher, from line 44 and the pumpable coal-solvent slurry from line 9 are mixed together in line 10 in the amount of about 1,000 to 100,000, such as about 2000 to 15,000 Standard Cubic Feet (SCF) of hydrogen-rich gas per barrel of coal-solvent slurry. The coal-solvent slurry is preferably preheated to the reaction temperature prior to introduction into liquefaction reaction zone 8. A digestion reaction takes place in liquefaction reaction zone 8 in at least one stage, with or without a conventional hydrogenation catalyst, at a temperature in the range of about 700° F. to 900° F., such as about 800° F. to 840° F.; a pressure in the range of about 0 to 300 atmospheres, such as about 54 to 204 atmospheres; and a residence time in the range of about 2 to 75 minutes, such as about 5 to 45 minutes. The operating conditions are chosen so as to maintain the hydrotreated solvent mixture and the dissolved coal in substantially liquid phase. The coal is thought to undergo thermally-induced scission of labile bonds within the coal structure to generate radicals. These radical intermediates are quickly stabilized by capping with relatively small fragments such as a hydrogen atom from the solvent mixture before they can undergo undesirable retrogressive reactions such as recombination or adduction which adversely affects the conversion of the coal to distillable products. From about 0.2–10 lbs. of solvent mixture are employed per lb. of solid coal entering liquefaction reaction zone 8. At least 70 weight percent of the ground coal (basis moisture and ash-free) is liquefied. Hydrogen lean solvent mixture in reaction zone 8 is hydrogenated in situ by the hydrogen-rich gas which is introduced through lines 44 and 10 in a sufficient amount so as to maintain the hydrogen content of the solvent mixture.

Optionally, a conventional hydrogenation catalyst may be employed in liquefaction zone 8, for example to reduce the residence time. The catalyst may be introduced in admixture with the coal slurry or the solvent mixture. Alternatively, fresh catalyst may be separately introduced into the liquefaction reactor and spent catalyst removed. Suitable catalysts include compounds containing cobalt, molybdenum, palladium, nickel, tin, tungsten, rhenium, zinc, iodine, and mixtures thereof; such as finely divided cobalt-molybdate catalyst or palladium on an alumina support.

In one embodiment, liquefaction reaction zone 8 comprises two stages of hydrotreating, e.g. a non-catalytic first stage followed directly by a catalytic second stage. In the first stage reactor or dissolver, the ground coal in the slurry is thermally broken down and hydrotreated to produce soluble products under non-catalytic conditions, such as previously specified. Residence times may be in the range of about 2 to 15 minutes. The effluent from the dissolver is then catalytically hydrotreated to more desirable products at slightly milder reaction conditions, e.g., temperature of about 700° F. to 800° F., pressure of about 54 to 170 atmospheres, and residence times of about 5 to 45 minutes.

The effluent stream from liquefaction reactor 8, comprising a mixture of hydrogen containing gas, hydrocarbonaceous and carbonaceous gases and hydrocarbon liquids, is passed through line 11 into separation zone 12. By means of conventional gas and liquid separation techniques including fractional and vacuum distillation, the following separate streams are produced: (a) a mixture of hydrogen-containing gas, and hydrocarbonaceous and carbonaceous gases in line 20, (b) light hydrocarbon distillate having an atmospheric boiling point in the range of about 10° F. to 360° F. in line 21, (c) middle hydrocarbon distillate having an atmospheric boiling point in the range of about 360° F. to 480° F., in line 22, (d) heavy hydrocarbon distillate having an atmospheric boiling point in the range of about 480° F. to 1000° F., in line 23, and the remainder comprising a bottoms product comprising ash and a hydrocarbonaceous material, such as vacuum resid or asphalt, and/or a carbonaceous material, such as petroleum coke, in line 24.

By definition the mixture of hydrogen-containing, hydrocarbonaceous and carbonaceous gases in line 20 comprises $H_2$, $H_2S$, $CH_4$, $NH_3$, $C_2H_4$, $C_2H_6$, $C_3H_6$, $C_3H_8$, CO, $CO_2$, and mixtures thereof. This gas stream may be exported or used in the system as fuel gas. Alternatively, the constituents of the gas stream may be separated as valuable by-products.

All of the light distillate is removed from the system through line 21 for use as a valuable liquid hydrocarbon by-product. At least a portion, e.g., in the range of about 50–100 wt. %, such as about 75–95 wt. %, of the middle distillate stream in line 22 is passed through line 25 into solvent mixture hydrogenation zone 26 where the coal-derived solvent mixture is produced. The remainder, if any, of the middle distillate may be exported through line 27, valve 28, and line 29 as a by-product liquid hydrocarbon fuel.

All or a portion of the heavy distillate in line 23 may be used in one or more of the following ways depending on the desired end products: (1) as an intermediate feedstock for the production of petroleum by-products, (2) as feedstock to produce hydrogen-rich gas, and (3) as a portion of the liquid carrier in the preparation of the coal slurry. For example, a portion, e.g., about 10 to 100 wt. % of the heavy distillate in line 23 may be removed from the system through lines 23, 30, 31, valve 32, and line 33 and processed downstream into valuable petroleum by-products. Alternatively, a portion, e.g., about 10–100 wt. %, of the heavy distillate in line 23 may be passed through line 35, valve 36, line 37, 38 and 39 into hydrogen production zone 40, as a supplementary portion of the feed to the partial oxidation gas generator. Alternatively, a portion, e.g., about 10–100 wt. % of the heavy distillate may be passed through lines 23, 30, 41, valve 42, and line 4 into coal slurry preparation zone 2. Optionally, the untreated heavy distillate in line 4 may be mixed with the hydrotreated lighter fraction of recycle solvent in line 3 and the mixture is then introduced into slurry preparation zone 2.

Hydrogen-rich gas comprising at least 80 vol. % $H_2$ and the remainder, for example, carbon monoxide, and preferably substantially pure hydrogen, e.g., about 98 vol. % $H_2$ or higher, is introduced into coal liquefaction reactor 8 by way of line 44, and also into the solvent mixture hydrogenation zone 26 by way of line 45. As previously mentioned, the hydrogen required for the subject process is economically produced by the partial oxidation of all of the hydrocarbon bottoms stream 24 which is the principal feed that is introduced into hydrogen production zone 40 by way of lines 24, 38 and 39. Heavy hydrocarbon distillate from line 23 constitutes supplementary feed to the hydrogen production zone 40. Start-up and make-up hydrocarbon fuel may be introduced into the hydrogen production zone 40 through line 46, valve 47, and lines 48 and 39.

Hydrogen-rich gas is produced in zone 40 by the steps of partial oxidation of the liquid hydrocarbon fuel, preferably in admixture with steam from line 50, and a free-oxygen containing gas, e.g., substantially pure oxygen (greater than 95 mole % oxygen) from line 51 in a free-flow noncatalytic refractory lined gas generator to produce a gaseous mixture comprising $H_2$, CO, a mixture of gaseous impurities, and entrained particulate carbon and ash. After the steps of partial oxidation, gas cooling, scrubbing, water-gas shifting to convert the CO in said gaseous mixture to additional $H_2$ and $CO_2$, and purification, as described more fully in coassigned U.S. Pat. Nos. 3,097,081; 3,545,926; and 4,052,176, which are incorporated herein by reference, ash is removed from the system through line 52 and the hydrogen or hydrogen-rich gas is removed through lines 44 and 45 for use in liquefaction reaction zone 8 and solvent mixture hydrogenation zone 26, respectively. The ash may be processed to separate valuable metals including those used in the preparation of the hydrogenation catalyst. The partial oxidation gas generator may be operated at a temperature in the range of about 1700° F. to 3000° F. and a pressure in the range of about 1 to 250 atmospheres. Preferably, the pressure in the gas generator is above that required for the hydrogen-rich gas in liquefaction and hydrogenation zones 8 and 25. Savings in costly gas compressors are thereby effected. Further, the thermal efficiency of the process is improved since the hydrogen-rich gas coming from zone 40 may be produced at an elevated temperature, e.g., about 100° F. and 1000° F. Preheating of the hydrogen is thereby eliminated or minimized.

In solvent mixture hydrogenation zone 26, the middle liquid hydrocarbon distillate that is introduced as feedstock through line 25 substantially comprises a mixture of unreacted decalins, tetralin, and naphthalene. Optionally, there may also be present about 5.0 wt. % or less of the mono and/or di methyl derivatives of at least one of the other constituents. Hydrogenation of the middle distillate takes place in zone 26 at a temperature in the range of about 40° F. to 850° F., such as about 212° F. to 800° F., say about 212° F. to 570° F., and a pressure in the range of about 0.1 to 204 atmospheres, such as about 34 to 136 atmospheres in the presence of a hydrogenation catalyst. The hydrogenated solvent mixture is passed through lines 53 and 3 into slurry preparation zone 2 where the pumpable coal-solvent mixture slurry is prepared.

Preferably, the hydrogenation catalyst may be finely divided pure metal ruthenium, rhodium, rhenium, iridium, platinum, and mixtures thereof, such as described in U.S. Pat. Nos. 3,349,139 and 3,349,140, which are incorporated herein by reference. The oxides or sulfides of a metal in the group consisting of ruthenium, rhodium, rhenium, and mixtures thereof may also be used. Further, a non-hydrogenating support, such as carbon, alumina, or silica-alumina, may also be used to support the catalyst. For example, the catalyst may comprise 5 wt. % metal and 95 wt. % support.

In the solvent mixture hydrogenation reaction zone 26, the hydrogen-rich gas to liquid hydrocarbon feed ratio may be in the range of about 1000 to 15,000, such as about 2000 to 10,000 standard cubic feet of hydrogen-rich gas per barrel of liquid hydrocarbon middle distillate feed. Sufficient hydrogen-rich gas is supplied to saturate the solvent mixture and to maintain an excess of hydrogen. The solvent mixture is contacted with hydrogen-rich gas at a temperature and pressure within the specified ranges until a hydroaromatic-perhydroaromatic solvent mixture (an "over hydrotreated" solvent) is produced comprising the following:

| | | Wt. % |
|---|---|---|
| (1) | Decalin (Decahydronaphthalene) | 78–95 |
| (2) | Naphthalene | 0–2 |
| (3) | Mono and/or Di Methyl derivatives of at least one of the other constituents in the solvent mixture | 0–5 |
| (4) | Tetralin (1,2,3,4-tetrahydronaphthalene) | Remainder, e.g., 1–22 |

Further, the decalin in said solvent mixture comprises cis and trans isomers in which the weight percent of the cis-isomers is at least 80 weight %, such as 85–97 wt. %, of the total weight of the decalin.

EXAMPLE

The results obtained in the following example illustrate the effectiveness of using cis-decalin over trans-decalin as a coal liquefaction solvent.

Illinois No. 6 bituminous coal having the composition shown in Table I was ground to a particle size of less than 75 μm Standard Sieve Designation ASTM E 11.

TABLE I

| Elemental Analysis | Moisture and Ash-Free (MAF) Coal % | Proximate Analysis % | |
|---|---|---|---|
| C | 73.95 | Moisture | 0.90 |
| H | 5.21 | Ash | 13.40 |
| N | 1.47 | Volatile matter | 37.9 |
| S | 4.43 | Fixed carbon | 47.8 |
| O (by difference) | 14.94 | | |

Duplicate samples consisting of 2.5 grams of the ground Illinois No. 6 bituminous coal in admixture with 5 grams of cis-decalin (Run Numbers 1 and 2) were introduced into a 35 ml microreactor bomb, charged with 600 psi. of substantially pure hydrogen, and reacted for 30 minutes at a temperature of 800° F. and a shaking rate of 375 rpm. The tests were repeated under the same test conditions but with new 2.5 gram samples of ground Illinois No. 6 bituminous coal in admixture with 5 grams of trans-decalin (Run Numbers 3 and 4). The yields, expressed as wt. % MAF coal are reported in Table II below.

TABLE II

| | Yields, Wt. % MAF Coal | | | |
|---|---|---|---|---|
| | Cis-Decalin Run No. | | Trans-Decalin Run No. | |
| Coal Conversion to | 1 | 2 | 3 | 4 |
| Gases | 4.04 | 3.25 | 3.06 | 3.72 |
| Heptane Soluble Oils | 50.2 | 47.4 | 38.2 | 39.2 |
| Asphaltenes | 5.04 | 6.43 | 4.80 | 6.15 |
| Total Coal Conversion to Toluene Soluble Materials | 59.3 | 57.1 | 46.1 | 49.1 |

The results in Table II show that cis-decalin is clearly the better solvent for coal liquefaction.

Obviously, various modifications of the invention as hereinbefore set forth may be made without departing from the spirit and scope thereof and therefore, only such limitations should be made as are indicated in the appended claims.

I claim:

1. A process for the liquefaction of ground coal or similar liquefiable carbonaceous solids which comprises:

(1) introducing a pumpable slurry of dried ground coal or liquefiable carbonaceous solids with a solvent mixture produced in (4) into a liquefaction reaction zone where a digestion reaction takes place while in the presence of about 1000 to 100,000 standard cubic feet of hydrogen-rich gas from (3) per barrel of slurry so that the hydrogen content of said solvent is maintained; wherein said solvent is a mixture comprising at least 78 wt. % decalin comprising cis-and trans-decalin and with the cis-decalin comprising at least 80 wt. % of the total weight of the decalin, about 0–2 wt. % of naphthalene and/or about 0–5 wt. % of constituent comprising the mono and/or dimethyl derivative of at least one of the other constituents in the solvent mixture, and the remainder of the solvent mixture comprising tetralin; and wherein said digestion reaction takes place at a temperature in the range of about 700° F. to 900° F., a pressure in the range of about 0 to 300 atmospheres, and a residence time in the range of about 2 to 75 minutes; and wherein said operating conditions are chosen so as to maintain said solvent mixture and the dissolved coal in substantially liquid phase;

(2) separating the effluent from (1) in a separating zone into (a) a gaseous mixture comprising hydrogen-containing gas, and hydrocarbonaceous and carbonaceous gases, (b) light hydrocarbon distillate having an atmospheric boiling point in the range of about 10° F. to 360° F., (c) middle hydrocarbon distillate having an atmospheric boiling point in the range of about 360° F. to 480° F., (d) heavy hydrocarbon distillate having an atmospheric boiling point in the range of about 480° F. to 1000° F., and (e) a bottoms product;

(3) producing a hydrogen-rich gas from the bottoms product with or without admixture with a portion of the heavy hydrocarbon distillate from (2) in a hydrogen-producing zone including free-flow partial oxidation, cooling, scrubbing, water-gas shifting, and purifying to produce said hydrogen-rich gas at the temperature and pressure for the liquefaction reaction zone in (1) and/or the solvent mixture hydrogenation zone in (4); and (4) in a solvent mixture hydrogenation zone catalytically hydrogenating at a temperature in the range of about 40° F. to 850° F. and a pressure in the range about 0.1 to 204 atmospheres at least a portion of the middle distillate from (2) with a portion of the hydrogen-rich gas produced in (3) while in contact with a hydrogenation catalyst selected from the group consisting of finely divided pure metal ruthenium, rhodium, rhenium, irridium, platinum, and mixtures thereof; or the oxides or sulfides of a metal selected from the group consisting of ruthenium, rhodium, rhenium, and mixtures thereof so as to produce the solvent mixture that is reacted in (1).

2. The process of claim 1 wherein the digestion reaction in (1) takes place in the presence of the hydrogenation catalyst.

3. The process of claim 1 where in step (1) the ratio of solvent mixture to coal in said liquefaction reaction zone is about 0.2 to 10 parts by weight of solvent mixture per part by weight of dried ground coal or similar liquefiable carbonaceous solids.

4. The process of claim 1 provided with the steps of producing the hydrogen-rich gas in step (3) by the partial oxidation of the bottoms product with or without admixture with a portion of the heavy hydrocarbon distillate from step (2) to produce a gaseous mixture comprising hydrogen, carbon monoxide, gaseous impurities, and entrained particulate carbon and ash; converting the carbon monoxide in said gaseous mixture into additional hydrogen plus $CO_2$; and purifying the gas mixture to produce said hydrogen-rich gas.

5. The process of claim 1, wherein the dried ground coal or similar liquefiable carbonaceous solids has a particle size in the range of about ASTM E11–70 Sieve Designation Standard 300 μm (Alternative No. 50) to Standard 45 μm (Alternative No. 325) and is introduced into said liquefaction zone as a slurry with said solvent mixture having a solids content in the range of about 16 to 91 weight percent.

6. The process of claim 1 where a portion of the heavy hydrocarbon distillate separated in step (2) is mixed with the ground coal and solvent mixture to prepare said slurry.

7. The process of claim 1 wherein a liquid mixture comprising a portion of distillate (2) (d) and the solvent mixture from (4) is mixed with the dried ground coal or liquefiable carbonaceous solids to produce the pumpable slurry in (1).

8. The process of claim 1 wherein said coal or liquefiable carbonaceous solids is selected from the group consisting of bituminous coal, sub-bituminous coal, anthracite coal, lignite, tar sands, oil shale, peat, and mixtures thereof.

9. The process of claim 1 wherein said hydrogenation catalyst in step (4) is supported and the support is selected from the group consisting of carbon, alumina, and silica-alumina.

10. The process of claim 1 where the liquefaction reaction in step (1) takes place at a temperature in the range of about 800° F. to 840° F. and a pressure in the range of about 54 to 204 atmospheres; and the hydrogenation reaction in (4) takes place in contact with ruthenium catalyst at a temperature in the range of about 212° F. to 570° F. and a pressure in the range of about 34 to 136 atmospheres.

11. The process of claim 1 where the liquefaction reaction in step (1) takes place in the presence of a hydrogenation catalyst containing a metal selected from the group consisting of cobalt, molybdenum, palladium, nickel, tin, tungsten, rhenium, zinc, iodine, and mixtures thereof.

12. The process of claim 1 including the steps in (1) of thermally breaking down and hydrotreating the ground coal in the slurry in a first stage reaction zone at a residence time in the range of about 2 to 15 minutes so as to produce soluble products under non-catalytic conditions; and catalytically hydrotreating the effluent from the first stage reaction zone in a second stage reaction zone at a temperature in the range of about 700° F. to 800° F., a pressure in the range of about 54 to 170 atmospheres, and a residence time in the range of about 5 to 45 minutes.

13. In a process for the liquefaction of ground coal or similar liquefiable carbonaceous solids in a liquefaction reaction zone; separating the effluent from said liquefaction reaction zone in a separation zone into gaseous and liquid fractions including heavy distillates and/or bottoms; producing hydrogen-rich gas in a partial oxidation reaction zone from a portion of said heavy distillate and bottoms; and using a first portion of said hydrogen-rich gas in said liquefaction reaction zone the improvement characterized by the steps of: removing from said separation zone a middle distillate fraction having an atmospheric boiling point in the range of about 360° F. to 480° F.; catalytically hydrogenating at least a portion of said middle distillate fraction in a solvent mixture hydrogenation zone with a second portion of said hydrogen-rich gas in the amount of 1000 to 15,000 standard cubic feet of hydrogen-rich gas per barrel of middle distillate so as to saturate the solvent mixture and to maintain an excess of hydrogen while in contact with a hydrogenation catalyst selected from the group consisting of finely divided pure metal ruthenium, rhodium, rhenium, irridium, platinum, and mixtures thereof; or the oxides or sulfides of a metal selected from the group consisting of ruthenium, rhodium, rhenium, and mixtures thereof, and while at a temperature and pressure for producing a solvent mixture comprising the following: 78 to 95 wt. % decalin comprising at least 80 wt. % cis-decalin and the remainder of the decalin is trans-decalin, about 0 to 2 wt. % naphthalene, and/or 0 to 5 wt. % of mono and/or di methyl derivative of at least one of the other constituents in the solvent mixture, and the remainder of the solvent mixture comprising tetralin; mixing together about 1,000 to 100,000 standard cubic feet of said hydrogen-rich gas with each barrel of a slurry comprising dried ground coal or liquefiable carbonaceous solids and said process derived hydrogenated solvent mixture with or without heavy distillate and/or bottoms from the separation zone; and reacting said slurry mixture with said hydrogen-rich gas with or without a hydrogenation catalyst in said liquefaction reaction zone.

14. The process of claim 13 wherein said middle distillate fraction is hydrogenated in said solvent mixture hydrogenation zone at a temperature in the range of about 212° F. to 570° F. and a pressure in the range of about 34 to 136 atmospheres while in the presence of a catalyst comprising ruthenium.

15. The process of claim 14 wherein said hydrogenation catalyst is supported and the support is selected from the group consisting of carbon, alumina, and silica-alumina.

16. The process of claim 13 wherein coal or liquefiable carbonaceous solids in a pumpable slurry mixture comprising 0.2 to 10 pounds of solvent mixture per pound of solid fluic is liquefied in said liquefaction reaction zone by thermally breaking down and hydrotreating the solid fuel to produce soluble products under non-catalytic conditions at a temperature in the range of about 700° F. to 900° F. and a pressure in the range of about 54 to 204 atmospheres followed by catalytically hydrotreating at a temperature in the range of about 700° F. to 800° F. and a pressure in the range of about 54 to 170 atmospheres.

* * * * *

UNITED STATES PATENT AND TRADEMARK OFFICE

CERTIFICATE OF CORRECTION

PATENT NO. : 4,551,224

DATED : 11/5/85

INVENTOR(S) : Erven J. Kuhlmann

It is certified that error appears in the above—identified patent and that said Letters Patent is hereby corrected as shown below:

column 8, line 4, instead of "the", insert --a-- column 10, line 25, instead of "fluic", insert --fuel--

Signed and Sealed this

*Twenty-eighth* Day of *January 1986*

[SEAL]

*Attest:*

DONALD J. QUIGG

*Attesting Officer*

*Commissioner of Patents and Trademarks*